US008887502B2

(12) United States Patent
Hauser

(10) Patent No.: US 8,887,502 B2
(45) Date of Patent: Nov. 18, 2014

(54) PRESSURE BOOSTER AND DIECASTING ARRANGEMENT

(75) Inventor: Daniel Hauser, St. Gallen (CH)

(73) Assignee: Bühler Druckguss AG, Uzwil (CH)

( * ) Notice: Subject to any disclaimer, the term of this patent is extended or adjusted under 35 U.S.C. 154(b) by 737 days.

(21) Appl. No.: 13/140,133

(22) PCT Filed: Dec. 17, 2009

(86) PCT No.: PCT/EP2009/067462

§ 371 (c)(1),
(2), (4) Date: Jun. 16, 2011

(87) PCT Pub. No.: WO2010/070073

PCT Pub. Date: Jun. 24, 2010

(65) Prior Publication Data

US 2011/0247485 A1 Oct. 13, 2011

(30) Foreign Application Priority Data

Dec. 17, 2008 (DE) ..... 10 2008 055 542

(51) Int. Cl.

| | |
|---|---|
| ***F15B 11/00*** | (2006.01) |
| ***B22D 17/32*** | (2006.01) |
| ***B22D 17/20*** | (2006.01) |
| ***F15B 3/00*** | (2006.01) |

(52) U.S. Cl.

CPC ..... *B22D 17/32* (2013.01); *B22D 17/2069* (2013.01); *F15B 3/00* (2013.01); *F15B 2211/214* (2013.01)

USPC ..... 60/547.1; 60/563

(58) Field of Classification Search

CPC ..... F15B 3/00; F15B 5/00; B22D 17/2069; B22D 17/2076; B22D 17/32

USPC ..... 60/547.1, 563, 593; 92/181 R; 164/155.3, 154.8

See application file for complete search history.

(56) References Cited

U.S. PATENT DOCUMENTS

| | | | | |
|---|---|---|---|---|
| 4,208,879 | A * | 6/1980 | Segawa | 60/547.1 |
| 4,884,621 | A * | 12/1989 | Ban et al. | 164/154.8 |
| 4,993,226 | A * | 2/1991 | De Kok | 60/547.1 |
| 5,773,050 | A | 6/1998 | Wohlrab | |

FOREIGN PATENT DOCUMENTS

| | | | |
|---|---|---|---|
| DE | 1949360 | | 4/1970 |
| DE | 2911074 | | 9/1980 |
| DE | 4022159 | | 5/1991 |
| DE | 4302235 | | 8/1993 |
| EP | 1604755 | A1 * | 12/2005 |
| JP | 46-036237 | | 10/1971 |
| JP | 2-211965 | | 8/1990 |
| WO | 2006/042508 | | 4/2006 |

* cited by examiner

*Primary Examiner* — Thomas E Lazo
(74) *Attorney, Agent, or Firm* — Shoemaker and Mattare

(57) ABSTRACT

A pressure booster (1) for a die casting machine, comprises a pressure booster piston (4) having a valve seat (7), wherein the pressure booster piston (4) interacts with the valve seat (7) to form a shut-off or non-return valve (6). The valve body (24) is displaceable to a limited extent in the axial direction (a) and can be retained hydraulically in a starting position.

24 Claims, 3 Drawing Sheets

PRESSURE BOOSTER AND DIECASTING ARRANGEMENT

Figure 1:
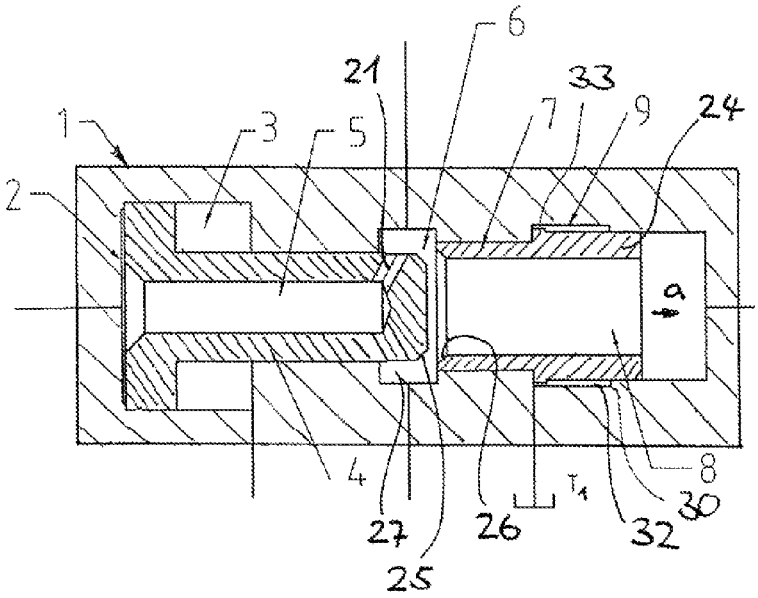

The invention relates to a pressure booster in drive devices for die casting machines. Furthermore, the invention relates to a die casting arrangement having a pressure booster of this type and a working or casting cylinder. However, the pressure booster can also be used in drive devices for presses or other work machines.

Pressure boosters having a pressure booster piston and a nonreturn valve integrated into the latter or having an external bypass nonreturn valve have been known and customary for a relatively long time. A nonreturn valve of this type prevents the return flow of hydraulic medium out of a high pressure space of a consumer to the piston space of the pressure booster. A pressure booster having a nonreturn valve which is integrated into the pressure booster piston has been disclosed, for example, in DE 1 949 360 A.

The known solutions are distinguished by an impeded throughflow cross section and relatively high production costs. In addition, the spring prestress means which is customarily used in the nonreturn valve is susceptible to failure.

It is therefore an object of the invention to avoid the disadvantages of the known pressure booster and, in particular, to provide a pressure booster which makes simple and reliable operation possible.

According to the invention, this object is achieved by a pressure booster as described below.

A plurality of advantages can be achieved as a result of the fact that the pressure booster has a valve seat which is operatively connected to the pressure booster piston and thus forms an advantageous nonreturn valve. The pressure booster is distinguished by a compact and simultaneously simple design. However, this solution is also favorable in flow terms. The shutoff or nonreturn valve according to the invention makes comparatively large flow cross sections possible in the open position. The casting devices can be operated more dynamically and with greater performance as a result.

The abovementioned pressure booster piston can preferably be configured as a step piston which consists substantially of a piston part which is accommodated in a cylinder and a piston rod which adjoins it coaxially therein and has a smaller diameter than the piston part. The cylinder is then closed in the region of the end side which faces the piston part and forms, together with said piston part, a working space which is called a "piston space". Here, the cylinder defines an annular working space in the region of the piston rod. In the following text, this working space is also called the annular space of the pressure booster.

In a first embodiment, on an end side which faces the valve seat, the pressure booster piston can be configured as a valve cone with a sealing face. A seat valve can be formed together with a corresponding sealing face which is arranged on the valve seat. The pressure booster piston can therefore bear sealingly against the valve seat in a closed position.

It can be advantageous if the valve seat can be displaced from an initial position in the axial direction in a preferably limited manner. This allows, in a first step, a closing stroke of the pressure booster piston for closing the shutoff or nonreturn valve, while, in a further step, the valve seat is displaced together with the pressure booster piston during the effective working stroke of the pressure booster piston.

If, as mentioned in the preceding text, the valve seat has, for example, a conical sealing face in the region of the end side which faces the pressure booster piston, onto which sealing face the preferably complementarily configured valve cone of the pressure booster piston comes to lie over the full surface area in the shut position, reliable closure of the shutoff or nonreturn valve can be ensured as a result.

It is possible in principle to hold the valve seat in an initial position with the use of mechanical spring means for producing a prestressing force. However, it can be particularly advantageous if hydraulic means are provided, with the aid of which the valve seat can be held hydraulically in its initial position.

The hydraulic means can advantageously produce a restoring force, by way of which a displaced valve seat can return automatically into its initial position again. With this arrangement, no further movable mechanical components are necessary with the exception of the valve seat. The flow opening of the valve body can therefore remain free of mechanical baffles. As a result, the operational reliability, the mechanical reliability and the service life of the pressure booster can be increased. In addition, the inclination to bounce of the valve seat during a hard impact of the pressure booster piston on the valve seat can be reduced by hydraulic positioning.

The valve seat can be equipped with an annular space which is connected to the tank in a pressureless manner. However, said annular space of the valve seat can also be connected to a pressure source. The pressure action in the annular space has to hold the valve seat in the basic position counter to the flow force of the main medium flow.

The valve seat is advantageously configured in such a way that the hydraulically active faces on the valve seat, formed by, for example, an annular face, lead to a force action of the valve seat on a stroke stop which faces the pressure booster piston. Thus, for example, the valve seat can be configured in such a way that it has a ratio of the annular face of that side of the valve seat which faces the pressure booster piston to the ring face of that side of the valve seat which faces away from the pressure booster piston, with the result that, in the normal operating state of the pressure booster, the valve seat is prestressed in the direction of the pressure booster piston and/or into the initial position. Here, the annular faces are dimensioned in such a way that the resulting force from the pressure of that side of the valve seat which faces away from the pressure booster piston, and the corresponding annular face is greater than the resulting force from the pressure of that side of the valve seat which faces the pressure booster piston with the corresponding annular face. Every further element for prestressing the valve seat can therefore be omitted.

The valve seat and/or the pressure booster can have a limiting means which limits the stroke of the valve seat in the pressure booster.

The limiting means can be, for example, an annular collar which is arranged on the outer wall of the valve seat, interacts with an annular groove of the pressure booster and thus limits the stroke of the valve seat in the pressure booster in a robust, simple and inexpensive construction.

The pressure booster piston can have a preferably axial hole, via which a piston space is connected or can be connected directly or indirectly to an accumulator. This design variant permits particularly generous and therefore low loss dimensioning of the holes which supply the piston space of the pressure booster with hydraulic pressure. As a result, a very dynamic response of the pressure booster piston is made possible. A pressure booster piston of this type can be produced simply. Furthermore, a particularly reliable method of operation and favorable flow guidance are possible by way of this arrangement.

The hole can be configured as a blind bore, the hole extending in the axial direction starting from the piston space-side end of the pressure booster piston. Here, the hole cross section can be comparatively large and can reach, for example, between 25% and 50% of the rod cross section. The hole does not necessarily have to have a constant diameter over the entire length. The hole can also have a, for example conical, insertion section or an insertion section which tapers as a result of another shape, is arranged at the piston space-side end and is adjoined in the direction of the piston rod by a hole section with a constant diameter.

The pressure booster piston can have at least one passage, in particular in the form of a hole, which extends transversely in relation to the axial direction, for the hydraulic connection of the preferably cylindrical cavity provided by the hole to the accumulator and/or to the working cylinder. The passage hole can extend in a manner with respect to the longitudinal center axis which is inclined at a right angle or by any desired angle of inclination. The at least one passage can be arranged in the region of that end of the pressure booster piston which faces the valve seat. It is particularly advantageous if a plurality of passages are provided which are distributed preferably uniformly over the circumference. The passages make a connection of the hole to an inflow space of the shutoff or nonreturn valve possible. Said passage holes open directly into the inflow space of the shutoff or nonreturn valve without impairing the sealing face of the pressure booster piston.

The triggering of the pressure booster piston from an initial position on the piston-side stop into a working position with a closed seat valve can be capable of being actuated by a switchable pressure booster adding valve on the annular space of the pressure booster.

The pressure booster can be configured in such a way that a closing stroke of the pressure booster piston can be carried out in order to close the shutoff or nonreturn valve. The closing stroke of the pressure booster piston forms the valve opening of the shutoff or nonreturn valve. Here, a movement within the closing stroke is understood as meaning that the pressure booster piston moves in the direction of the working cylinder which is connected behind the pressure booster, and that no additional pressure is yet produced in the piston space of the working cylinder on account of the shutoff or nonreturn valve which is still open.

A further aspect of the invention relates to a die casting arrangement having the pressure booster which is described in the preceding text. Furthermore, the arrangement has a working cylinder which is connected to the working cylinder in order to increase the pressure in the piston space of the working cylinder. The working cylinder, pressure booster piston and valve seat of the pressure booster can be oriented coaxially with respect to one another.

The annular space of the pressure booster can be connected via a connecting line to the annular space of the working cylinder in such a way that the respective annular spaces can be loaded with a pressure prestress by means of an annular space valve. This has the advantage that both the working piston and the pressure booster can have their respective methods of operation influenced over a broad application range. The output pressure of the pressure booster, that is to say the piston pressure in the working cylinder, is lowered by the pressure at the annular space of the pressure booster. The force action of the working cylinder is reduced by the pressure in the annular space of the working cylinder. If both influences interact, the result is a much more pronounced influence of the force action of the working piston, since the annular space pressure at the pressure booster also has a reducing effect on the piston pressure of the working cylinder.

The arrangement can have a pressure accumulator as a hydraulic energy source. Said accumulator can be connected via a line to the inflow space of the shutoff or nonreturn valve. In addition, a hydraulic medium can be fed into or at any rate discharged from the inflow space of the shutoff or nonreturn valve via a second connection to a further pressure medium source, for example in the form of a hydraulic pump. This connection makes it possible to receive hydraulic medium from a hydraulic pump in the case of a relatively slow movement start of the working piston and, as a result, to ensure very gentle and jolt-free starting.

It can be advantageous for an optimum sequence of the casting process if, furthermore, an adding valve is arranged in the abovementioned connecting line for actuating the annular space of the pressure booster. Here, the connecting line between the adding valve and annular space valve can be connected or can be capable of being connected to the hydraulic energy source via a supply valve. Furthermore, the connecting line between the adding valve and the annular space valve can be connected or can be capable of being connected to the inflow space of the shutoff or nonreturn valve by means of a differential valve.

The annular space of the pressure booster, the annular space of the working cylinder and the inflow space of the shutoff or nonreturn valve can be connected to one another via lines in such a way that a return movement of the working cylinder, the valve seat and the pressure booster piston of the pressure booster can be brought about in a simple way via a valve arrangement comprising supply valve, adding valve and tank valve. This refinement has the advantage, furthermore, that the return movement of the working piston, the valve seat and the pressure booster piston can be brought about purely hydraulically in a simple way via a valve arrangement comprising an open supply valve, an open adding valve, and a closed tank valve. Actuating rods which are used particularly commonly, are susceptible to failure and reduce the throughflow of the shutoff or nonreturn valve are omitted.

A further aspect of the invention relates to a pressure booster for increasing the pressure in a piston space of a working cylinder, a pressure booster piston forming, together with a valve seat, a pressure booster.

Figure 2:
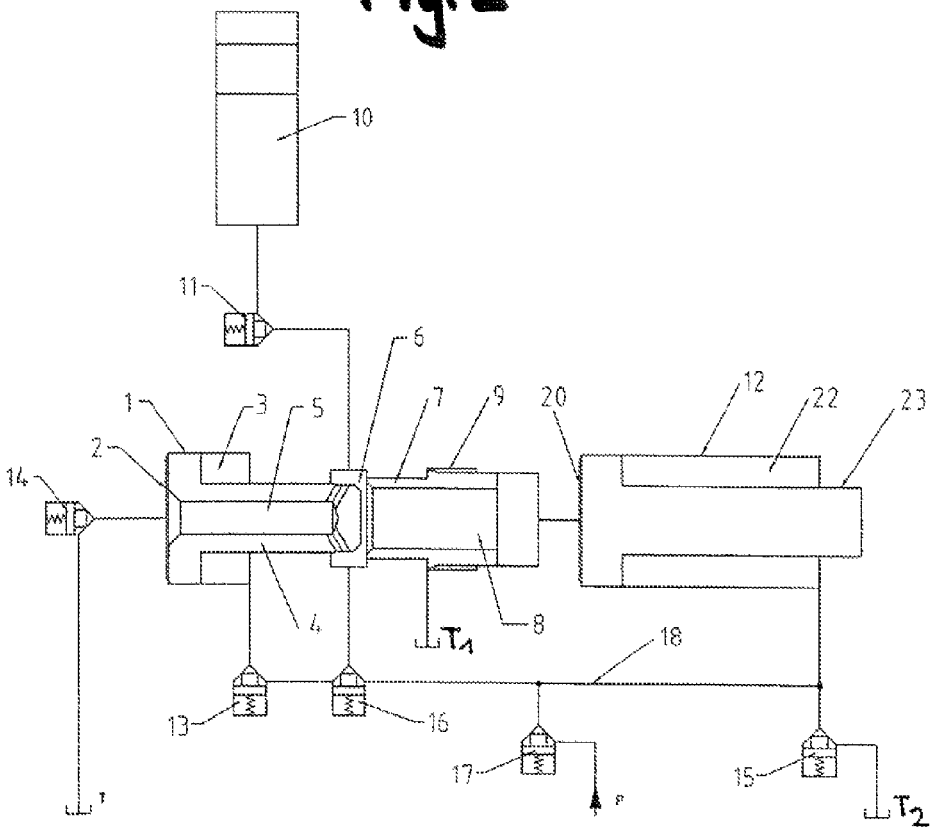
Figure 3:
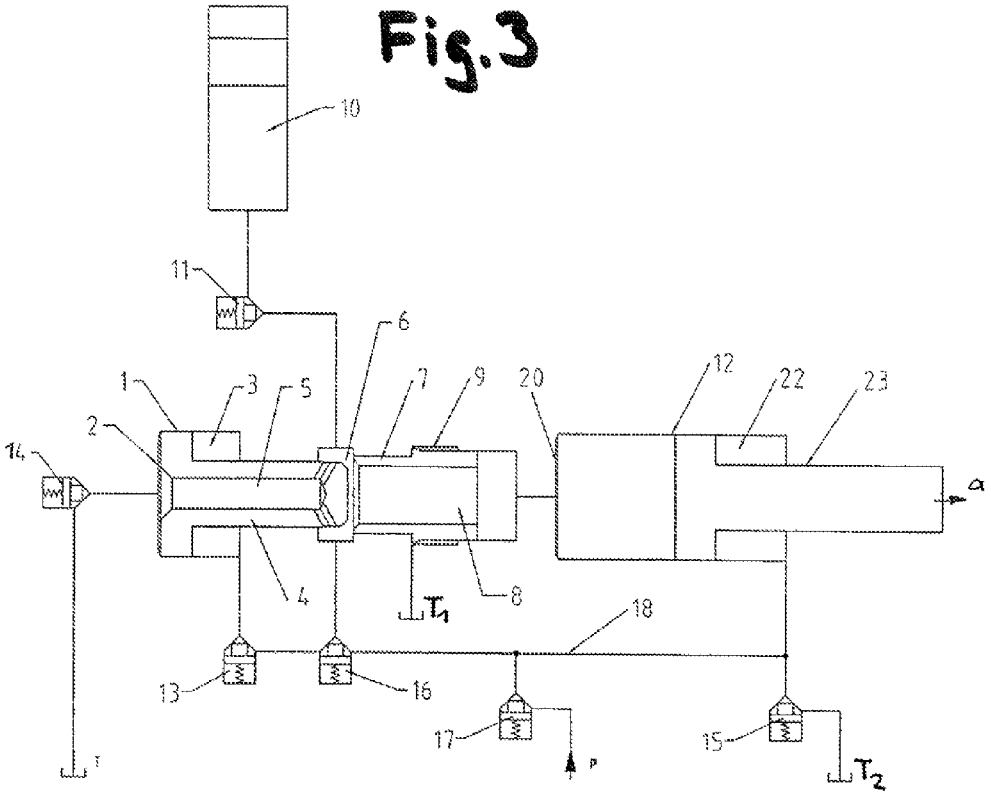
Figure 4:
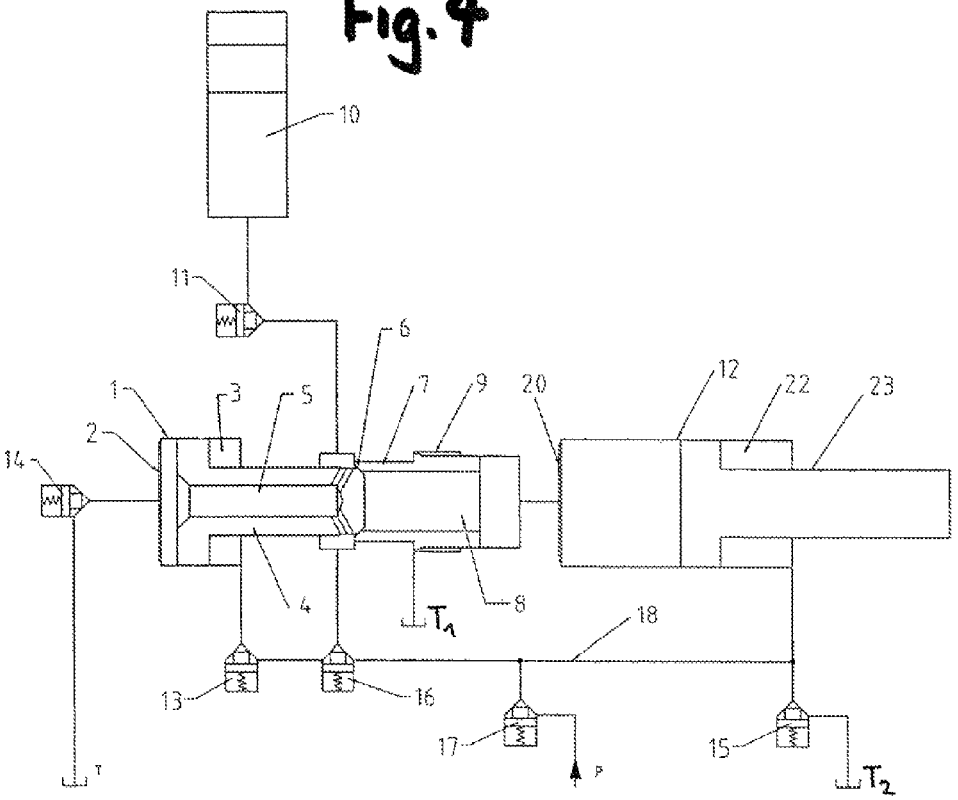
Figure 5:
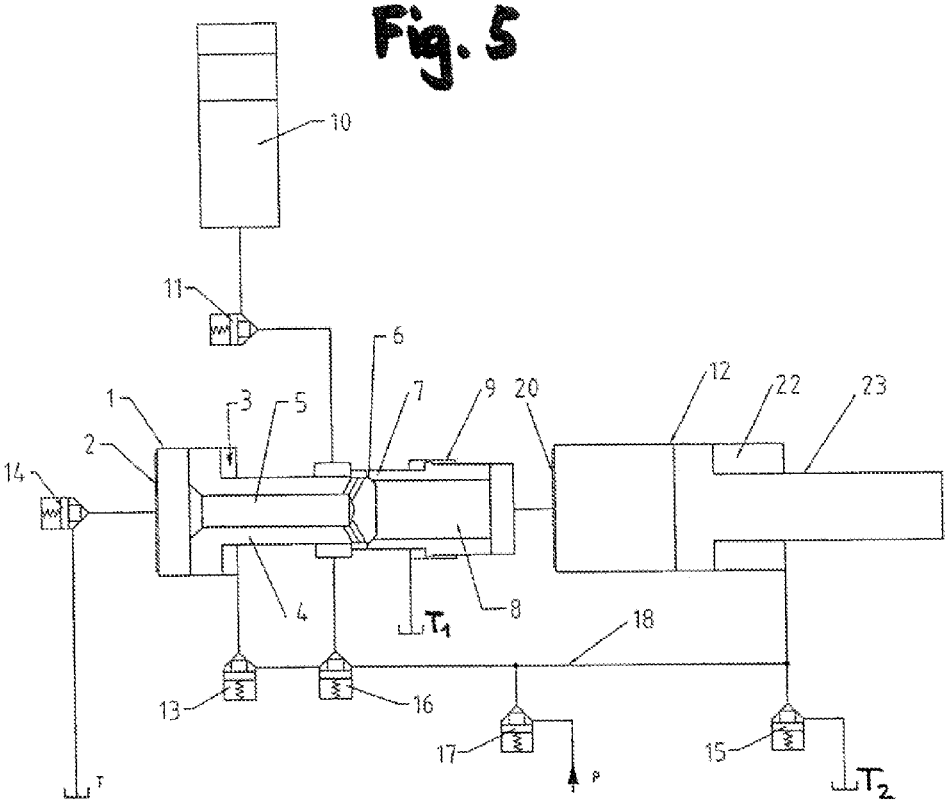
Figure 6:
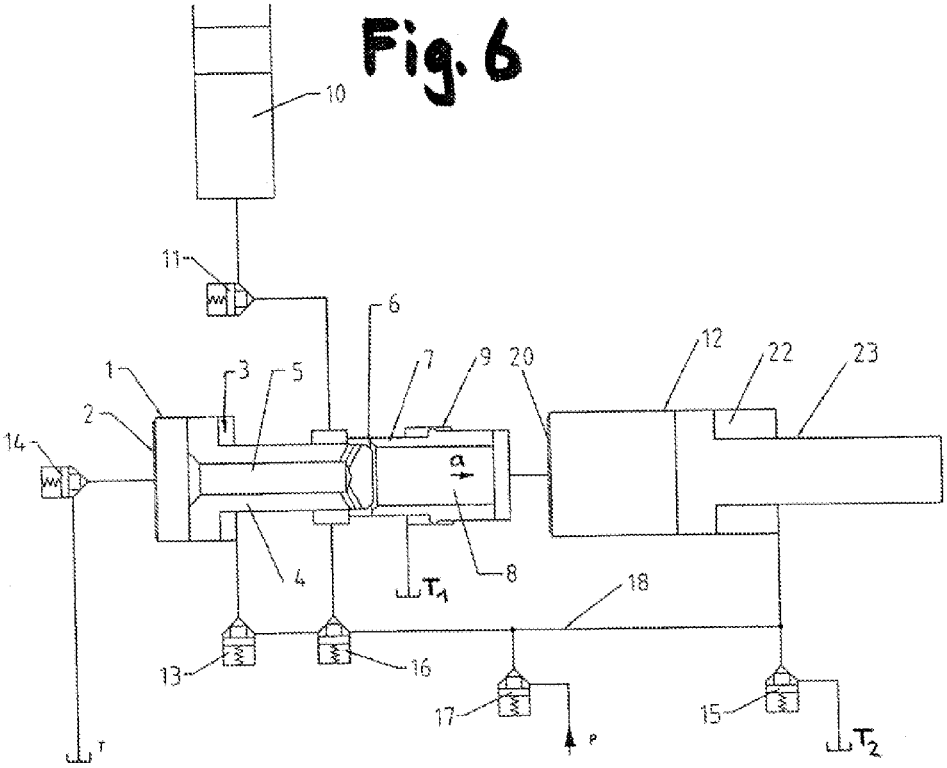

Further individual features and advantages of the invention result from the following description of exemplary embodiments and from the drawings, in which:

FIG. 1 shows a simplified sectional illustration of a pressure booster according to the invention, FIG. 2 shows a basic view of a die casting arrangement with the pressure booster from FIG. 1 in a basic position, FIG. 3 shows the arrangement according to FIG. 2 after a first working step in a casting process, FIG. 4 shows the arrangement after a further working step with the pressure booster in a closed position at the beginning of a pressure dwell phase, FIG. 5 shows the arrangement during the pressure dwell phase with the compression stroke having been traveled, and FIG. 6 shows the arrangement in a last working step during ejection of a solidified sprue pellet.

FIG. 1 shows a pressure booster which is denoted by 1 and can be used to increase the pressure in a piston space of a working cylinder (not shown here). A pressure booster of this type can be installed, for example, in a die casting machine or a press.

Various lines are provided for integration into an arrangement for a die casting machine. In FIG. 1, the respective connections for feeding in and discharging a hydraulic medium are indicated in a simplified manner by dashes. In relation to the centrally arranged, approximately annular inflow space, two connections for pressure medium supply can be seen, for example. The individual interfaces and the components connected to them are shown and explained in the following FIGS. 2 to 6.

The pressure booster 1 comprises a pressure booster piston 4 which consists of a piston part and a piston rod which adjoins it coaxially. As can be seen, the piston part has a greater diameter than the piston rod and, on an end side, defines the piston space which is denoted by 2. The annular space 3 of the pressure booster is situated on the other side of the piston part. Furthermore, a valve seat 7 which is arranged such that it can be displaced in the pressure booster housing in the axial direction can be seen in FIG. 1. Together with the pressure booster piston 4, the sleeve-shaped valve seat 7 makes a shutoff function possible which will be described in greater detail in the following text. The pressure booster housing which is shown only diagrammatically in FIG. 1 can be assembled from a plurality of cylinder sections.

The shutoff or nonreturn valve which is integrated into the pressure booster and is denoted by 6 is formed by the valve seat 7 and pressure booster piston 4 which can be moved with respect to one another. In the present exemplary embodiment, the inflow space 27 of the shutoff or nonreturn valve 6 is situated approximately centrally in relation to the axial direction. As can be clearly seen from FIG. 1, the pressure booster piston 4 and the valve seat 7 have sealing faces 25 and 26. On the pressure booster piston 4, a conical valve cone section 25 is situated on the end-side end and a sealing face 26 of complementary configuration is situated on the valve body 24. As can be seen, the pressure booster piston 4 is configured as a valve cone on the end side which faces the valve seat 7. Together with the valve seat 7, said valve cone forms a seat valve. In the closed position, the shutoff or nonreturn valve brings about shutting off of the hydraulic fluid connection between the flow opening which is denoted by 8 and the inflow space 27 (cf. following FIGS. 4 and 6).

The pressure booster piston has a hole 5 which extends in the axial direction. As can be seen, this supply hole 5 has an approximately conical insertion section in the region of the piston space-side end side, which insertion section is adjoined by a section with an approximately constant diameter. The hole 5 is configured as a blind bore; one or more passage holes 21 which are arranged transversely with respect to the axial direction serve for the hydraulic connection. Said passage holes 21 can be arranged at any desired angle with respect to the axial direction, 60° here by way of example. They connect the blind bore 5 in the pressure booster piston 4 to the inflow space 27 of the shutoff or nonreturn valve 6. This refinement can ensure a very high throughflow rate from the energy source in the inflow space 27 to the piston side 2 of the pressure booster piston 4, which in turn makes high dynamics of the pressure booster 1 possible.

The valve seat 7 which comprises a single component has a smaller external diameter on the side of the sealing face 26 and a larger external diameter on the side which faces the outlet. These two different diameters form a hydraulically active annular face which leads via a pressure difference to an axial force action in the direction of the basic position. Said annular face is preferably connected to the tank. The higher operating pressure which acts on the remaining faces then brings about the restoring force via this face difference, in order to hold the valve seat in the basic position. A shoulder 33 which adjoins said annular face serves for stroke limitation.

FIG. 2 shows the pressure booster 1 in a die casting arrangement. Said arrangement has, as consumer, a working cylinder 12, in which a working piston 23 is arranged displaceably. The arrangement has a hydraulic energy source 10, for example an accumulator, which is connected via a line to the inflow space 27 of the shutoff or nonreturn valve. However, in theory it would also be conceivable that the hydraulic energy source is connected to another working space of the arrangement. Thus, for example, the line to an accumulator adding valve 11 could also open into the piston space 2 of the pressure booster 1. The hydraulic energy source 10 is connected to the working cylinder 12 via the accumulator adding valve 11 and the shutoff or nonreturn valve 6. Here, the flow conditions in the accumulator adding valve 11, the shutoff or nonreturn valve 6 and the valve seat 7 influence the maximum volumetric flow of the hydraulic medium.

The pressure booster piston 4 is configured at the piston rod-side end as a valve cone of the shutoff or nonreturn valve 6. The valve seat 7 of the shutoff or nonreturn valve 6 is axially displaceable, in order that the pressure booster 1 together with the valve seat 7 can increase the working pressure at the consumer, that is to say in the working cylinder 12.

As a result of the hydraulic operative connection mentioned in the preceding text between the valve seat 7 and the annular face which is connected to the tank $T_1$ via a hydraulic line, the face difference at the valve seat holds the valve seat 7 reliably in the basic position, even in the case of a very high flow speed. As a result, the flow opening 8 of the valve seat 7 can remain free of mechanical baffles, which increases the throughflow rate and the mechanical reliability of the construction. In addition, the hydraulic positioning reduces the inclination to bounce of the valve seat during the hard impact of the pressure booster piston 4 on the valve seat 7, since, in contrast to the mechanical retention, a defined force counteracts the bouncing of the valve seat 7.

In addition to the abovementioned tank $T_1$, two further tanks ($T$, $T_2$) can be seen in FIG. 2. The annular space 3 of the pressure booster is connected to the annular space 22 of the working cylinder 12 via a connecting line 18. This achieves a situation where the respective annular spaces 3 and 22 can be loaded with a pressure prestress by means of an annular space valve 15. This pressure prestress in the connecting line 18 can be formed by means of a pressure divider by the hydraulic valves 15 and 17 or can be generated by an independent pressure limiting or pressure reducing valve. Furthermore, an adding valve 13 for actuating the annular space 3 is arranged in the connecting line 18. The connecting line 18 between the adding valve 13 and the annular space valve 15 is then connected via a supply valve 17 to a hydraulic energy source P. The pressure supply can be carried out both by a second pressure accumulator or, in the extreme case, also by the accumulator 10 via the valves 11 and 16. However, this minimum variant is not optimum in energy terms. A switching valve 16 which is called a "differential valve" is situated in the connecting line between the adding valve 13 and the annular space valve 15. The return movement of the working piston 23, the valve seat 7 and the pressure booster piston 4 takes place by feeding in pressure via a supply valve 17, with an open adding valve 13 and an open tank valve 14. Here, the annular space valve 15 and the differential valve 16 have to be closed.

For improved understanding of the method of operation of the novel pressure booster 1, FIGS. 3 to 6 show the various sequences of a casting process. The principal casting sequence is known per se to a person skilled in the art and has already been implemented for a relatively long time in conventional casting arrangements. The starting point is the basic position which is shown in FIG. 2. By the valves 13, 14 and 17 being opened, both the pressure booster piston 4, the valve seat 7 and the casting plunger 23 are moved into the basic position. The remaining hydraulic valves remain closed.

In a next step, a first advance of the casting plunger 23 takes place at a slow speed. To this end, after the valves 11 and 16 are opened, the casting plunger 23 moves in the direction a in an energy saving manner with an initially reduced casting force. All the other valves remain closed during this advancing phase.

Rapid advancing of the casting plunger with full casting force then takes place as a result of the valves 11 and 15 being opened. All the other valves are closed.

The pressure booster piston 5 is set in motion by the valve 13 being opened. The shutoff or nonreturn valve 6 is closed when the pressure booster piston 4 comes into contact with the valve seat 7. This position is shown in FIG. 4. As can be seen, the valve cone of the pressure booster piston 4 comes into contact with the valve seat 7. As can be seen, the conical sealing face of the valve seat 7 rests with its full area in the closed position on the likewise conical valve cone section of the pressure booster piston 4, as a result of which an advantageous and practically leakfree shutoff can be achieved. The valves 11 and 13 remain open in this working step.

A pressure dwell phase then takes place (FIG. 5). The pressure in the closed piston space 20 of the working cylinder 12 is increased by compression as a result of a further displacement of the pressure booster piston 4 together with the valve seat 7. The action of the pressure booster and the working cylinder can be influenced in the pressure dwell phase via the common annular space pressure, connected via the connecting line 18 and open adding valve 13.

Finally, in a last working step of the casting operation, the casting plunger is moved further forward, in order to release the cast part from the fixed mold half. To this end, the adding valve 13 of the pressure booster is closed. The pressure booster piston 4 remains at a standstill. However, the valve seat 7 can move further forward in the direction a, which again causes a valve opening between the pressure booster piston 4 and the valve seat 7, that is to say the shutoff or nonreturn valve 6 is then in an open position again.

The invention claimed is:

1. A pressure booster for increasing the pressure in a piston space of a working cylinder, having a pressure booster piston, wherein the pressure booster has a valve seat, the pressure booster piston interacting with the valve seat in order to form a shutoff or non-return valve, wherein on an end side which faces the valve seat, the pressure booster piston is configured as a valve cone with a sealing face which interacts with a sealing face arranged on the valve seat and forms a seat valve, and the valve seat is configured in such a way that the hydraulically active faces on the valve seat, formed by, for example, an annular face, lead to a force action of the valve seat on a stroke stop which faces the pressure booster piston.

2. The pressure booster according to claim 1, wherein said working cylinder is a working cylinder of a die casting machine.

3. The pressure booster according to claim 1, wherein the valve seat can be displaced from an initial position in the axial direction in a limited manner.

4. The pressure booster according to claim 1, wherein in the normal operating state, the valve seat is pre-stressed in the direction of the pressure booster piston by means of a separate pre-stressing means.

5. The pressure booster according to claim 1, wherein the valve seat and/or the pressure booster have a limiting means which limits the stroke of the valve seat in the pressure booster.

6. The pressure booster according to claim 5, wherein the limiting means is an annular collar which is arranged on the outer wall of the valve seat, interacts with an annular groove of the pressure booster and thus limits the stroke of the valve seat in the pressure booster.

7. The pressure booster according to claim 1, wherein the pressure booster piston has a hole, via which a piston space is connected or can be connected directly or indirectly to an accumulator.

8. The pressure booster according to claim 7, wherein the hole is axial.

9. The pressure booster according to claim 7, wherein the hole is configured as a blind bore, the hole extending in the axial direction starting from the piston space-side end of the pressure booster piston.

10. The pressure booster according to claim 7, wherein the pressure booster piston has at least one passage which extends transversely in relation to the axial direction, for the hydraulic connection of the cavity provided by the hole to the accumulator and/or to the working cylinder.

11. The pressure booster according to claim 10, wherein the at least one passage is in the form of a hole.

12. The pressure booster according to claim 10, wherein the cavity provided by the hole is cylindrical.

13. The pressure booster according to claim 10, wherein the at least one passage makes a connection of the hole to an inflow space of the shutoff valve possible.

14. The pressure booster according to claim 1, wherein in order to trigger the pressure booster piston from an initial position into a working position with a closed shutoff valve, a pressure booster adding valve which is connected to an annular space of the pressure booster can be actuated.

15. The pressure booster according to claim 14, wherein the pressure booster adding valve is switchable.

16. The pressure booster according to claim 1, wherein the pressure booster is configured in such a way that a closing stroke of the pressure booster piston can be carried out before the shutoff or non-return valve is closed.

17. The pressure booster according to claim 1, wherein a line with an electrically actuated or actuable hydraulic valve connects an annular space of the pressure booster piston to an annular space valve to a tank or to a pressure pre-stressing means in the line.

18. The pressure booster according to claim 17, wherein the valve is a rapidly switching valve.

19. A die casting arrangement having a working cylinder and a pressure booster according to claim 1, wherein the pressure booster is connected to the working cylinder in order to increase the pressure in the piston space of the working cylinder.

20. The arrangement according to claim 19, wherein the working cylinder, the pressure booster piston and the valve seat of the pressure booster are oriented coaxially with respect to one another.

21. The arrangement according to claim 19, wherein an annular space of the pressure booster can be connected via a connecting line to an annular space of the working cylinder in such a way that the respective annular spaces can be loaded with a pressure pre-stress by means of an annular space valve.

22. The arrangement according to claim 21, wherein furthermore, an adding valve is arranged in the connecting line for actuating the annular space of the pressure booster, and in that the connecting line between the adding valve and annular space valve can be connected to a hydraulic energy source via a supply valve.

23. The arrangement according to claim 21, wherein the connecting line between the adding valve and annular space valve can be connected to an inflow space of the shutoff or non-return valve by means of a switching valve.

24. The arrangement according to claim 23, wherein the annular space of the pressure booster, the annular space of the working cylinder and the inflow space of the shutoff or non-return valve are connected to one another via lines in such a way that a return movement of the working cylinder, the valve seat and the pressure booster piston of the pressure booster can be brought about via a valve arrangement comprising supply valve, adding valve and tank valve.

* * * * *